United States Patent [19]

Hörnberg

[11] Patent Number: 4,518,186

[45] Date of Patent: May 21, 1985

[54] AUTOMATIC COUPLING DEVICE FOR LOADING PLATFORMS

[75] Inventor: Gunnar Hörnberg, Ramnäs, Sweden

[73] Assignee: Konstruktions Teknik, Upsala, Sweden

[21] Appl. No.: 503,133

[22] PCT Filed: Sep. 21, 1982

[86] PCT No.: PCT/SE82/00288

§ 371 Date: May 23, 1983

§ 102(e) Date: May 23, 1983

[87] PCT Pub. No.: WO83/01059

PCT Pub. Date: Mar. 31, 1983

[30] Foreign Application Priority Data

Sep. 23. 1981 [SE] Sweden ..... 81056293

[51] Int. Cl.[3] ..... B66C 1/38

[52] U.S. Cl. ..... 294/82.24; 294/110.1

[58] Field of Search ..... 294/83 R, 83 A, 84, 294/86.17, 86.2, 86.27, 86.29, 86.31, 86.33, 90, 110 R, 113, 116

[56] References Cited

U.S. PATENT DOCUMENTS

| | | | |
|---|---|---|---|
| 701,654 | 6/1902 | White | 294/86.27 X |
| 2,507,058 | 5/1950 | Stone | 294/86.27 |
| 2,537,829 | 1/1951 | Hohler | 294/83 R |
| 3,311,401 | 3/1967 | Bacon | 294/110 R X |
| 3,600,031 | 8/1971 | Coleman et al. | 294/110 R X |

FOREIGN PATENT DOCUMENTS

| | | | |
|---|---|---|---|
| 505866 | 10/1951 | Belgium | 294/110 R |
| 2303750 | 11/1976 | France | 294/110 R |
| 339299 | 10/1971 | Sweden . | |
| 433086 | 9/1975 | U.S.S.R. | 294/110 R |
| 479718 | 11/1975 | U.S.S.R. | 294/110 R |

*Primary Examiner*—Johnny D. Cherry

*Attorney, Agent, or Firm*—Witherspoon & Hargest

[57] ABSTRACT

An automatic coupling device for connecting and disconnecting respectively a loading platform (12) from a lifting hook (17) which by means of hoisting cables (16) is operated by a hoisting crane for transferring the loading platform (12). Inside the outercasing (15) of the coupling device a connecting mechanism is provided for engaging and detaining a connecting head (1) provided on a central extension rod (13) of the loading platform (12), which connecting mechanism comprises pivotally mounted legs (2 and 6 respectively), which by one of their end portions are pivotally mounted (at 7) in the outer casing (15) and the free end portions of which thereby may be swung towards each other and away from each other respectively. The legs (2 and 6 respectively) are provided with clutch jaws (37) which in the connected condition are intended to engage a narrow portion positioned below a thickened main portion of the connecting head (1) of the loading platform (12), and with a lock mechanism (5) which in the open condition for the connecting mechanism maintains the legs (2 and 6 respectively) at a distance from each other but which in the connected condition for the connecting mechanism is brought aside in such a way that the legs (2 and 6 respectively) are positioned close to each other by their free ends and in such a way that their clutch jaws (37) are in an active connecting position.

6 Claims, 10 Drawing Figures

AUTOMATIC COUPLING DEVICE FOR LOADING PLATFORMS

Figure 1:
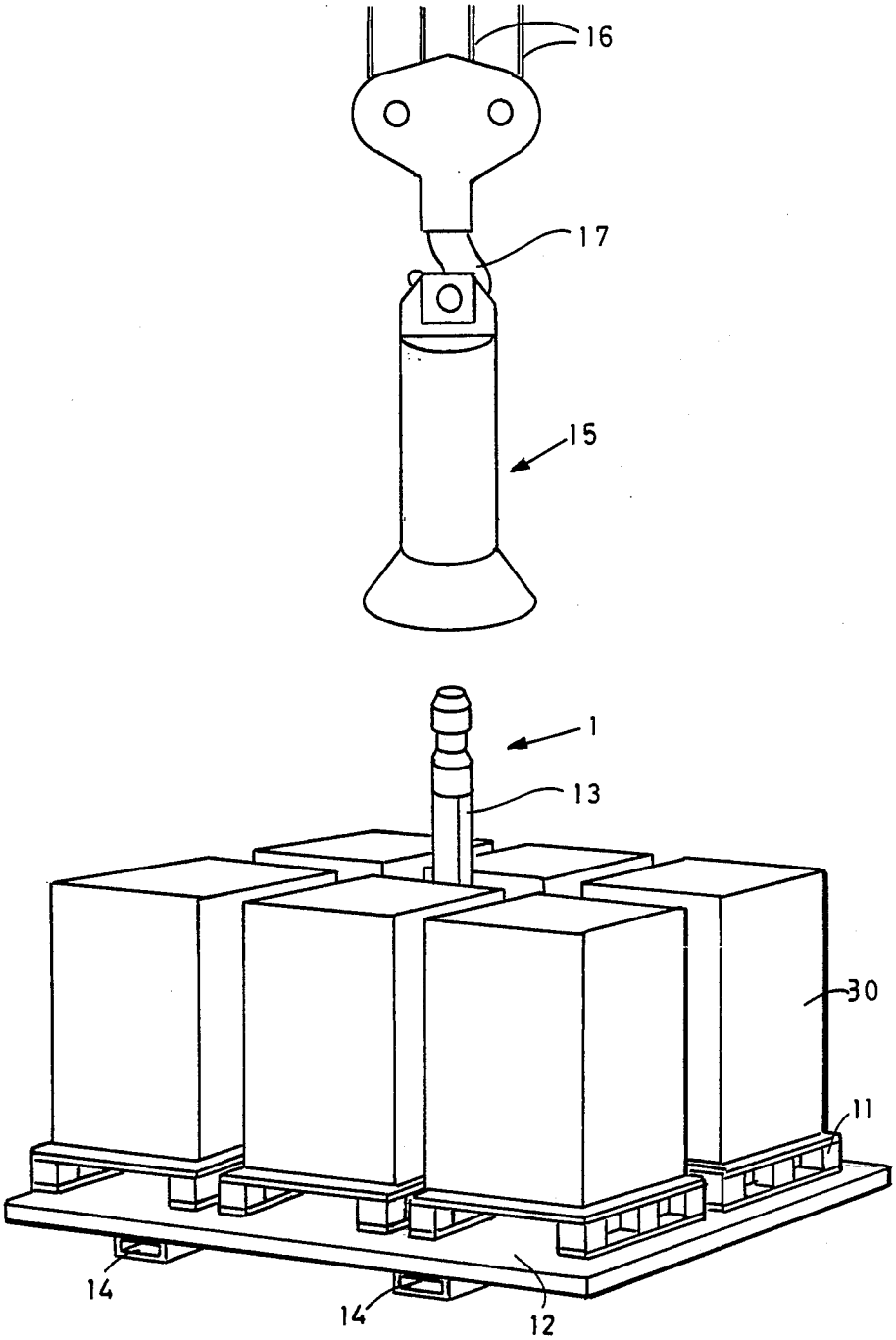

This invention relates to an automatic coupling device for connecting and disconnecting a loading platform or a loading plane to and from a lifting hook respectively, which lifting hook through hoisting cables is operated by a hoisting crane for transferring the pallets positioned on the loading platform or the loading plane between for instance a dock pier and a ship's deck.

Today a great portion of all goods is transported in standardized transport containers, but this system suffers from certain disadvantages. Among these disadvantages are the high manufacturing costs for the containers, the great space requirement in connection with the storage thereof when standing-by for loading or unloading, but most of all the expensive and time-consuming transport between the place where the containers receive their load (or where the load is unloaded) and the container ports which are getting bigger and bigger and which are necessary for a rational handling. Thus, there is a demand for a possibility to handle goods placed on common pallets in a rational way in connection with the loading and unloading thereof onto and from a ship respectively. The invention relates to such a system by means of which load placed on common pallets quickly and easily may be transferred between for instance the dock pier and the deck of a cargo ship. The use of the kind of handling system suggested in accordance with the invention will thus have the effect of promoting primarily the competition of the smaller ports due to the fact that the demand for loading all goods in containers which are then transported to the larger container ports will not be very great since also piece goods may be handled effectively and thus more economically directly from the pier to the deck of the cargo ship and reverse. Compared to the use of fork lifts or similar pallet fork systems this invention brings about the advantage that the time consumed for loading and/or unloading may be reduced to half while maintaining the same number of dock labourers.

An example of the kind of handling system suggested in accordance with the invention is illustrated in the Swedish printed and published specification No. 339.299 which discloses a loading plane on which piece goods is placed, and this loading plane may be transferred between two places by means of a crane. A hoisting frame connects the loading plane to the lower portion of a coupling device and at the hoisting cable of the hoisting crane an upper portion of the coupling device is attached to the lifting hook. The coupling device illustrated and described in said Swedish printed and published specification No. 339.299 does however suffer from certain disadvantages. Among these is the danger of obtaining an unsatisfactory arresting if the upper portion of the coupling device is brought down too quickly into the lower portion of the coupling device, whereby an instantaneous unlocking action is achieved and no lock-up will take place.

The object of the present invention is to eliminate among other things the above mentioned disadvantages of the prior art handling systems. By a device of the kind indicated in the preamble of the enclosed patent claims this object is achieved through the significant characteristic features of the invention, which features are also clear from the patent claims.

Figure 2:
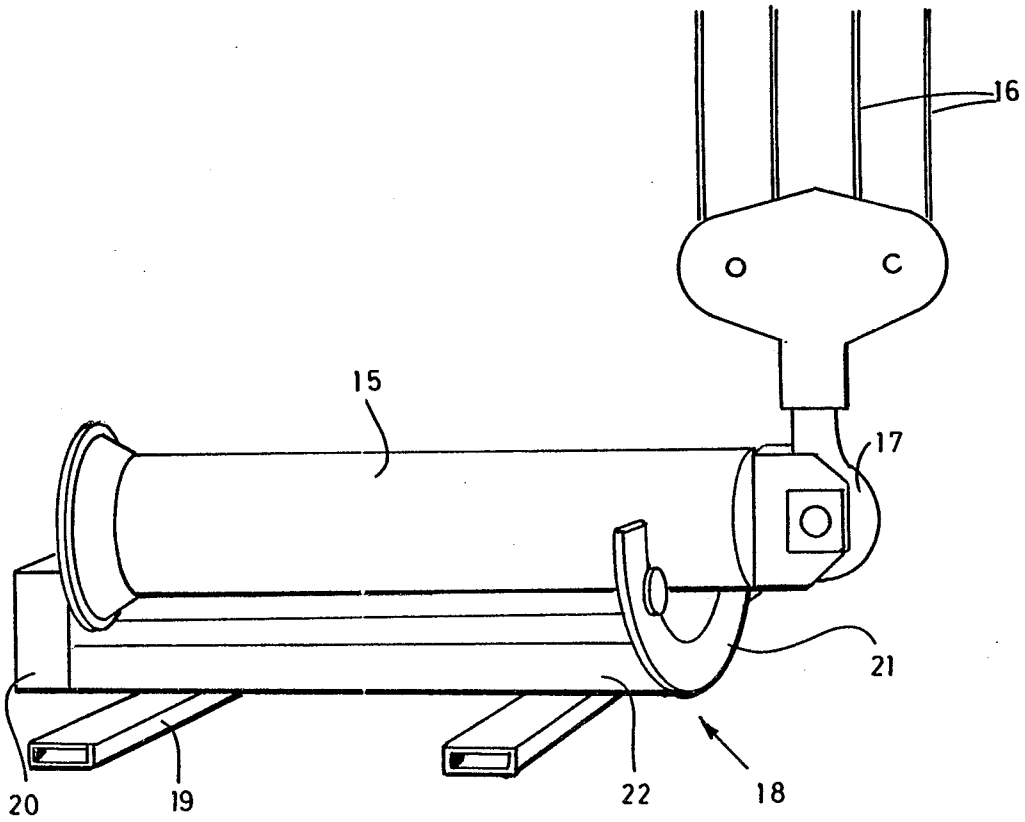
Figure 4:
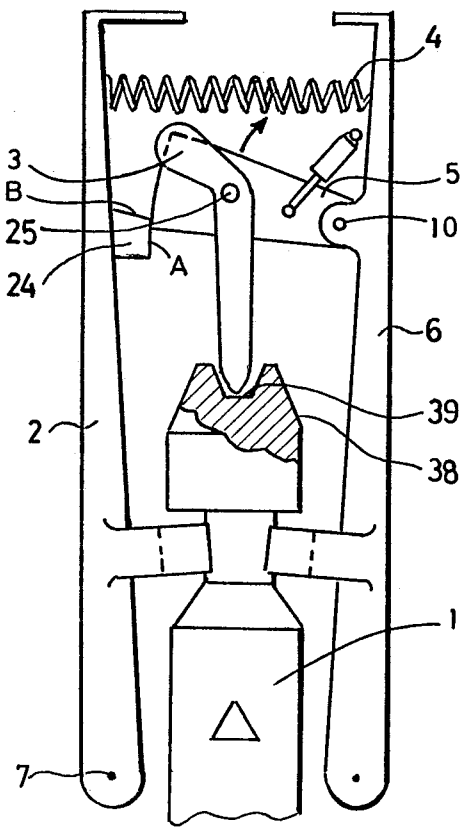
Figure 3:
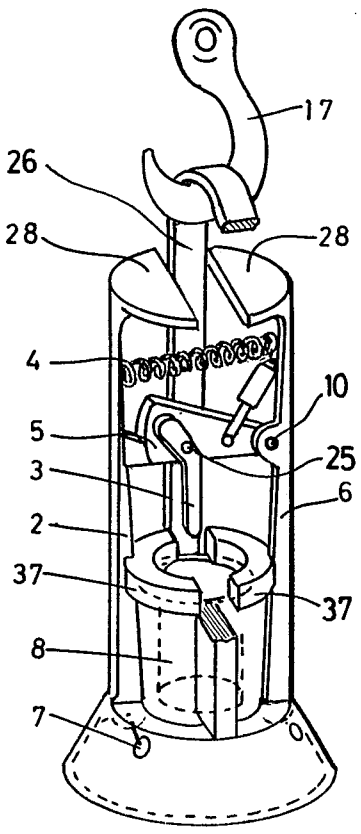
Figure 6:
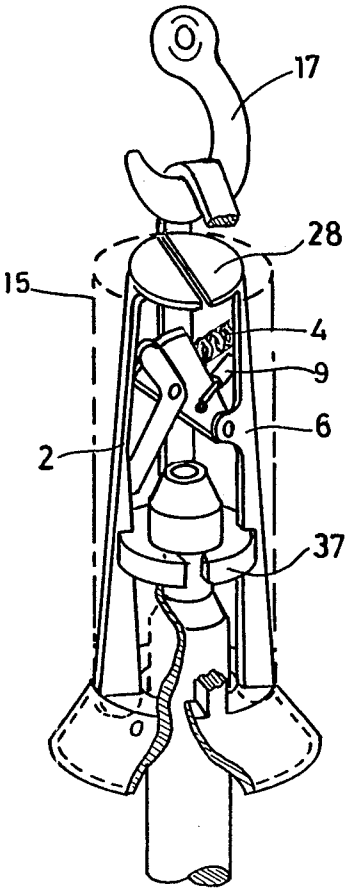
Figure 5:
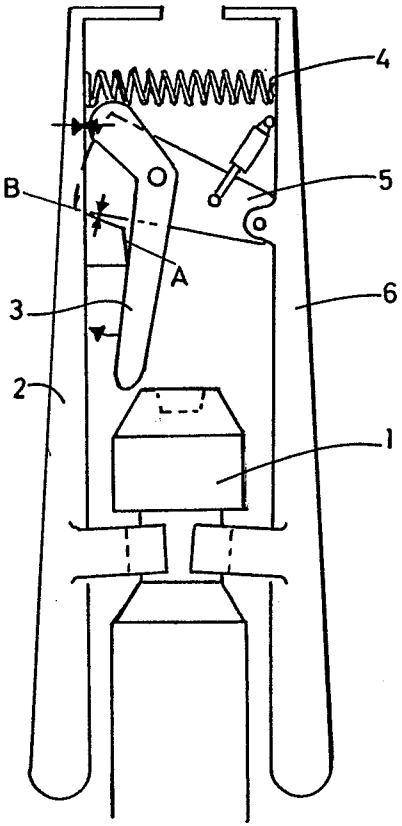
Figure 8:
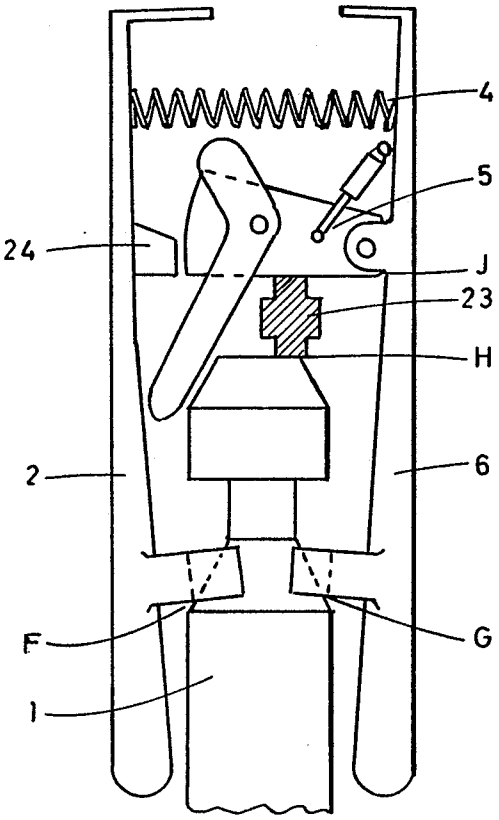
Figure 7:
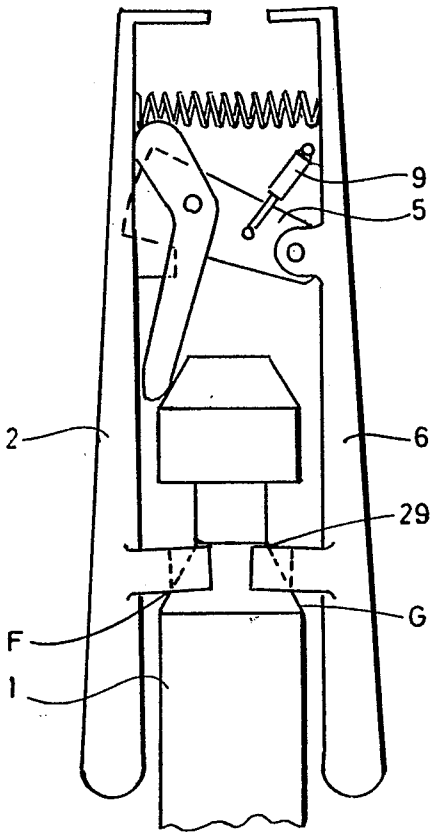
Figure 10:
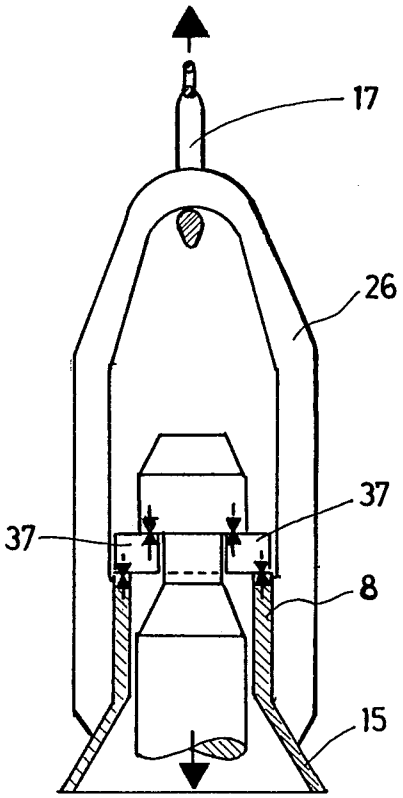
Figure 9:
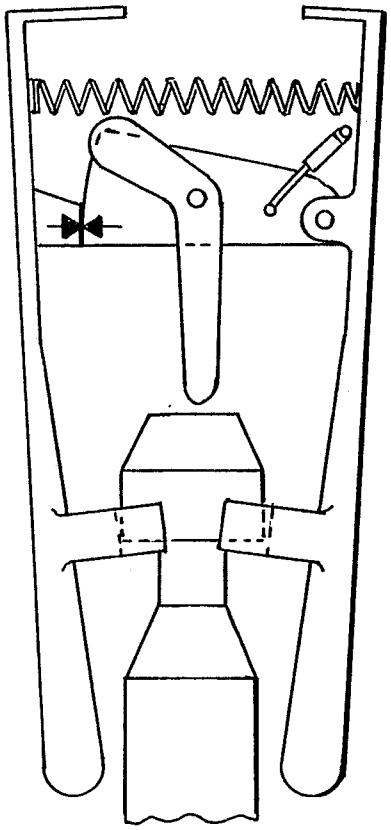

In the enclosed drawings,

FIG. 1 is a schematic, perspective overall view of the kind of handling system where the invention may be applied, FIG. 2 is a perspective view illustrating how the automatic coupling according to the invention may be stored in a cradle, which is designed especially for this purpose, when the coupling in not operated, FIG. 3 is a schematic, perspective view of the automatic coupling according to the invention in its opened condition when it is ready to be coupled together with a coupling head of a loading plane, FIGS. 4 and 5 are views illustrating different phases of the connecting operation for the automatic coupling according to the invention, FIG. 6 is a schematic, perspective view of the automatic coupling in its arresting connected position, FIGS. 7–9 are views illustrating different phases of the disconnecting operation for the automatic coupling, and FIG. 10 is a schematic view illustrating the power transmission through the automatic coupling between the hoisting crane hook and the loading platform.

FIG. 1 illustrates how the invention is intended to be used in a rational handling system for i.e. piece goods. The goods, here illustrated by the cardboard box 30, is preferably placed on pallets 11 and in the illustrated embodiment six such pallets 11 are placed on a loading platform or a loading plane 12. The loading platform 12 is in its centre provided with a lifting bar 13 the upper end of which is provided with a coupling head 1. The underside of the loading platform 12 is preferably provided with two rectangular tubes 14 so that it, in an empty or loaded condition, may be transported by means of for instance a fork lift.

FIG. 1 illustrates that the invention comprises an upper, automatic coupling device 15 which is intended to be supported by a hoisting crane, not shown, by means of the hoisting cables 16 and hook 17 of the crane.

FIG. 2 illustrates a particularly constructed cradle 18 which is intended to support the automatic coupling 15 when this is not in operation. The cradle 18 is supported by two rectangular tubes 19 shaped in such a way that the whole cradle 18 with the automatic coupling 15 may be transported to and from the place where it is stored and between different work places by means of for instance a fork lift. The cradle 18 is further provided with an end portion 20 which prevents the automatic coupling 15 from moving in a longitudinal direction, and at the other end of the cradle 18 there is provided an end piece 21 which is preferably of a semi-circular shape or of a U-shape and which engages the automatic coupling 15. Between these two end portions or end pieces longitudinal beams 22 are extended. As will be more closely explained below the cradle 18 is used in connection with the connecting and disconnecting of the automatic coupling 15 from the crane hook 17. Through the used, horizontal, fixed positioning of the automatic coupling 15 in the cradle 18 a safe connecting and disconnecting may be carried out, and hereby it is also possible to eliminate the risk that might exist if the automatic coupling 15 should be rigged in a self-supported, upright condition, namely the risk that the coupling might turn over and cause injuries.

The automatic coupling 15 may be matched with any desired kind of crane hook, for instance a 15 or 25 ton crane hook, and as will be obvious in view of the following detailed description of the connecting mechanism of the automatic coupling, the automatic coupling 15 will automatically grasp the coupling head 1 when it is lowered down over the lifting bar 13 of the loading platform 12 by means of the crane cables 16, whereupon the loading platform may be hoisted. When the loading platform 12 is put down again in such a way that the crane cables 16 slacken the automatic coupling 15 will be disengaged and will be separated from the lifting bar 13 of the loading platform 12. Two flaps 28 (see FIGS. 3 and 6) which are provided on the upper side of the automatic coupling 15, which are painted red and which are visible to the crane operator, indicate if the automatic coupling 15 is engaged or not. Thus, the automatic coupling is of the type that connects and disconnects respectively every other time it is lowered down in such a way that the crane cables 16 slacken.

Reference will now be made to FIGS. 3–9, which illustrate the connecting mechanism of the automatic coupling in its different conditions. Inside the outer casing of the automatic coupling 15 there is provided, as is clear from FIGS. 1 and 2, the connecting mechanism which will now be described more clearly at the same time as the conditions illustrated in the figures are explained. Two operating legs 2 and 6 respectively are pivotally mounted with their lower ends in fixed pivots 7 and the upper portions of the legs 2 and 6 are free to move towards and away from each other respectively. Between the legs a tension spring 4 is positioned, which spring is intended to pull the legs together when required. The legs 2 and 6 are kept apart from each other by means of a lock flap 5 which is pivotally mounted in the right leg 6 in a fixed pivot 10. In the open position for the connecting mechansim the lock flap 5 contacts on the one hand a vertically obstructing stop 23 (see FIG. 8) and on the other hand a horizontal lock lug 24 and in this position the free end surface of the lock flap 5 contacts the end surface A (see FIGS. 4 and 5) of the lock lug 24 which is provided on the left leg 2 approximately opposite the fixed pivot 10 of the lock flap 5. In this position, which is illustrated in FIG. 3, the connecting mechanism of the automatic coupling is maintained in its opened condition, and in this condition it is ready for the connecting phase.

A push rod 3 is provided on the lock flap 5. The push rod 3 is provided with a downwardly directed arm and an upper portion which is bent in such a way that it forms an angle with said arm. The push rod 3 is pivotally mounted to the lock flap 5 in a fixed pivot 25. Through this arrangement the push rod 3 will follow the lock flap 5 in its rotary motion around the fixed pivot 10, but the push rod 3 may in itself rotate around its fixed pivot 25. By the two legs 2 and 6 respectively clutch jaws 37 are provided which by the connecting operation are intended to engage the thinner portion positioned below the upper part of the connecting head 1.

The connecting head 1 is at its upper part provided with inwardly tapered outer surfaces 38 and a bowl-shaped recess 39 in its upper end surface.

In FIG. 4 it is illustrated how the push rod 3 has contacted the upper part of the connecting head when it has been inserted into the bowl-shaped recess 39. By a continued vertical relative motion between the connecting head 1 and the connecting mechanism the push rod 3 will push the lock flap 5 upwardly, and said lock flap will then be rotated around its fixed pivot 10 in such a way that its left (in the figure) end surface will be turned upwardly and will leave the surface A of the lock lug 24 during the rotary motion indicated by the arrow in FIG. 4.

When the lock flap 5 has been pushed upwardly during its rotary motion indicated by means of the arrow in FIG. 4, to such an extent that the lock flap 5 has passed the upper edge of the surface A of the lock lug 24 it will permit the legs 2 and 6 to be pulled towards each other by means of the tension spring 4 while the lock flap 5 simultaneously slides against a bevel cut upper surface B of the lock lug 24. The downwardly directed arm of the push rod 3 will thereby be swung in towards the leg 2, indicated by means of the lower rotational arrow in FIG. 5, and the tension spring 4 pulls the uppper ends of the legs 2 and 6 even further together in such a way that the lock flap 5 is rotated even further upwardly in FIG. 5 through its engagement with the inner surface of the leg 2.

FIG. 6 illustrates the automatic coupling in its final position in the connected condition. The legs 2 and 6 are thereby situated as close as possible to each other and are maintained in that position by means of the tension spring 4. The lock flap 5 is completely raised and is in its inactive rest position. Below the clutch jaws 37 there is provided a load carrying means 8 (see FIGS. 3 and 10) which functions as a pressure seat with its upper end surfaces engaging the underside of the clutch jaws 37. In FIG. 10 it is illustrated by means of the inserted force arrows, how the force is transmitted between the crane hook and the loading platform through the automatic coupling. In this connecting position the upper surfaces of the legs 2 and 6, which surfaces are bent inwardly and which overlap slightly, form indication surfaces 28 (FIG. 6), which indicate that the coupling is engaged and that a complete connection is established.

The automatic coupling will be in this condition as long as the crane cables 16 are stretched, that is as long as the loading platform 12 is lifted by means of the hoising crane. As soon as the loading platform 12 has been put down onto a surface (for instance the pier or the ship's deck), in such a way that the automatic coupling 15 may perform a relative motion downwardly with respect to the loading platform 12 a disconnecting phase will be initiated. This phase is illustrated in FIGS. 7–9.

When the loading platform 12 rests on the surface the automatic coupling 15 will be brought further downwardly in such a way that a gap is formed between the underside of the connecting head 1 and the clutch jaws 37 of the legs 2 and 6. These clutch jaws 37 will then engage a tapered surface F, G (FIGS. 7 and 8) of the connecting head 1, whereby the legs 2 and 6 will be brought aside from each other as is illustrated in FIGS. 7 and 8. When the coupling is lifted the lock flap 5 with its push rod 3 will be permitted to swing downwardly again around its fixed pivot 10, and by providing a hydraulic damper 9 the lock flap 5 is prevented from swinging down too rapidly since this might cause the coupling to be locked in an open position in the case where the loading platform 12 gets stuck somewhere and a recoil results in the crane cables. FIG. 8 illustrates the legs 2 and 6 in their most separated position, and the figure illustrates that there is a distance between the left end surface of the lock flap 5 and the lock lug 24. As has been pointed above the cables must slack off during some second in order to make it possible for the coupling to be released from the connecting head. Finally, FIG. 9 illustrates how the connecting head 1 is free after the disconnecting operation, and the automatic coupling 15 may now be lifted free of the loading platform 12 again and may be brought over to another loading platform for connection and for hoisting of the same.

As mentioned above FIG. 10 illustrates by means of inserted arrows how the force transmission takes place through the automatic coupling. The pull from the crane hook 17 is transmitted through a hoisting clamp 26 to the casing 15, and the downwardly directed gravity that is to be overcome is transmitted from the connecting head 1 through the clutch jaws 37 to the load transmitting means 8 illustrated in FIGS. 10 and 3. Hereby, the downwardly directed forces and the upwardly directed forces which act on the clutch jaws 37 balance each other.

To a man skilled in the art it is obvious that the invention may be varied and modified in certain respects within the scope of the invention such as this is stated in the enclosed patent claims, which determine the protective scope of this patent.

I claim:

1. A coupling apparatus which may be automatically coupled and uncoupled relative to a loading platform for raising and lowering said platform attached to said coupling apparatus comprising:

(a) a coupling head having a first end attached to said loading platform and a second end extending from said loading platform;

(b) a casing open at one end and at an opposite other end, said one end being attachable to a hoisting cable;

(c) a pair of opposing legs one end of each of which extends into said one end of said casing for pivotal attachment to said casing;

(d) a jaw extending from each of said legs to form a pair of opposing jaws; and (e) means attached to said legs for automatically causing said legs to pivot about their pivotal attachment to pull said opposing legs and said opposing jaws towards each other so that said jaws are coupled to said coupling head when said casing is lowered a first time so that said head extends into said other end of said casing, and for automatically causing said legs to pivot about their pivotal attachment to push said opposing legs and said opposing jaws away from each other so that said jaws are uncoupled from said coupling head when said casing is lowered a subsequent second time and said cable is slackened to an extent to allow said casing to be removed relative to said coupling head said causing means including a lock flap one end of which is pivotally attached to one of said legs of said pair and the other end of which extends towards a lock lug extending from the other of said legs of said pair, said other end of said lock flap engaging said lock lug when said jaws are uncoupled from said coupling head, and push rod means pivotally attached to said lock flap for causing said lock flap to pivotally disengage said lock lug allowing said jaws to be pulled together to couple said jaws to said coupling head when said push rod means engages said coupling head as said head extends into said other end of said casing as said casing is lowered said first time.

2. The apparatus of claim 1 wherein said second end of said coupling head includes a first tapered outer surface and an axially directed recess, and wherein said push rod means includes a first portion extending towards said other end of said casing, said first portion of said push rod means being pivotable to engage said recess as said coupling head extends into said other end of said casing as said casing is lowered said first time causing said lock flap to pivotally disengage said lock lug allowing said jaws to be pulled together to couple said jaws to said coupling head, and said first portion of said push rod means being pivotable to engage said tapered outer surface of said coupling head as said casing is lowered said subsequent second time and said cable is slackened causing said jaws to be pushed away from each other and said lock flap to pivotally engage said lock lug so that said jaws are uncoupled from said coupling head.

3. The apparatus of claim 2 wherein said push rod means further includes a second end portion extending in a direction away from said other end of said casing of said legs, and wherein said lock lug includes an inclined surface positioned relative to said second end portion so that said second end portion may slide upon said inclined surface when said push rod means pivot relative to said lock flap.

4. The apparatus of claim 1 further including a damper attached between one of said legs and said lock flap.

5. A coupling apparatus including a loading platform having a coupling head for having automatically coupled thereto or automatically uncoupled therefrom a pair of opposing jaws for raising and lowering said platform as desired using a hoisting cable attached to said coupling apparatus, said apparatus comprising:

(a) said coupling head having a first end attached to said loading platform and a second end extending from said loading platform, said second end including a first tapered outer surface and an axially directed recess, and a second tapered outer surface positioned between said first end and said first tapered outer surface;

(b) a casing open at one end and at an opposite other end, said one end being attachable to said hoisting cable;

(c) a pair of opposing legs one end of each of which extends into said one end of said casing and is pivotally attached to said casing and an opposing end of each of which extends from said one end of said casing and includes means attached thereto for indicating whether said opposing jaws are coupled to or uncoupled from said coupling head;

(d) said opposing jaws including a jaw extending from each of said legs to form said pair of opposing jaws which may be coupled to or uncoupled from said coupling head, said jaws positioned for sliding movement with said second tapered surface during said coupling and uncoupling;

(e) a lock flap one end of which is pivotally attached to one of said legs of said pair and the other end of which extends towards a lock lug extending from the other of said legs of said pair, said other end of said lock flap engaging said lock lug when said jaws are uncoupled from said coupling head, said lock lug including an inclined surface;

(f) push rod means pivotally attached to said lock flap for causing said lock flap to pivotally disengage said lock lug allowing said jaws to be pulled together to couple said jaws to said coupling head when said push rod means engages said coupling head, said push rod means including a first portion extending towards said other end of said casing said first portion of said push rod means being pivotable to engage said recess as said coupling head extends into said other end of said casing as said casing is lowered a first time, and said first portion of said push rod means being pivotable to engage said first tapered outer surface of said coupling head as said casing is lowered a subsequent second time and said cable is slackened, said push rod means further including a second end portion extending in a direction away from said other end of said casing and positioned relative to said inclined surface so that said second end portion may slide upon said inclined surface when said push rod means pivots relative to said lock flap;

(g) a tension spring having a first end attached to one of said legs and a second end attached to the other of said legs; and, (h) a damper attached between one of said legs and said lock flap.

6. A coupling apparatus including a loading platform having a coupling head for having have a pair of opposing jaws automatically coupled thereto or automatically uncoupled therefrom for raising and lowering said platform as desired using a hoisting cable attached to said coupling apparatus, said apparatus comprising:

(a) said coupling head having a first end attached to said loading platform and a second end extending from said loading platform, said second end including a first tapered outer surface and an axially directed recess, and a second tapered outer surface positioned between said first end and said first tapered outer surface;

(b) a casing open at one end and at an opposite other end, said one end being attachable to said hoisting cable, and means provided internal of said casing for load carrying engagement with said opposing jaws;

(c) a pair of opposing legs one end of each of which extends into said one end of said casing and is pivotally attached to said casing and an opposing end of each of which extends from said one end of said casing;

(d) said opposing jaws including a jaw extending from each of said legs to form said pair of opposing jaws which may be coupled to or uncoupled from said coupling head, said jaws positioned for sliding movement with said second tapered surface during said coupling and uncoupling;

(e) a lock flap one end of which is pivotally attached to one of said legs of said pair and the other end of which extends towards a lock lug extending from the other of said legs of said pair, said other end of said lock flap engaging said lock lug when said jaws are uncoupled from said coupling head, said lock lug including an inclined surface;

(f) push rod means pivotally attached to said lock flap for causing said lock flap to pivotally disengage said lock lug allowing said jaws to be pulled together to couple said jaws to said coupling head when said push rod means engages said coupling head, said push rod means including a first portion extending towards said other end of said casing, said first portion of said push rod means being pivotable to engage said recess as said coupling head extends into said other end of said casing as said casing is lowered a first time, and said first portion of said push rod means being pivotable to engage said first tapered outer surface of said coupling head as said casing is lowered a subsequent second time and said cable is slackened, said push rod means further including a second end portion extending in a direction away from said other end of said casing and positioned relative to said inclined surface so that said second end portion may slide upon said inclined surface when said push rod means pivots relative to said lock flap;

(g) a tension spring having a first end attached to one of said legs and a second end attached to the other of said legs; and, (h) a damper attached between one of said legs and said lock flap.

* * * * *